US008635823B2

(12) United States Patent
McCary

(10) Patent No.: US 8,635,823 B2
(45) **Date of Patent: *Jan. 28, 2014**

(54) RADIANT INSULATING, VENTING AND MOISTURE CONTROL ASSEMBLY

(76) Inventor: John Milner McCary, Birmingham, AL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/507,797

(22) Filed: Jul. 30, 2012

(65) Prior Publication Data

US 2013/0199126 A1 Aug. 8, 2013

Related U.S. Application Data

(63) Continuation-in-part of application No. 12/923,972, filed on Oct. 19, 2010, now Pat. No. 8,291,660.

(51) Int. Cl.
*E04D 13/17* (2006.01)
*E04F 13/00* (2006.01)

(52) U.S. Cl.
USPC ..... 52/302.3; 52/169.14

(58) Field of Classification Search
USPC ..... 52/169.14, 302.1, 302.3, 302.6, 408, 52/413, 506.01
See application file for complete search history.

(56) References Cited

U.S. PATENT DOCUMENTS 4,199,636 A * 4/1980 Clark ..... 428/114
5,383,314 A * 1/1995 Rothberg ..... 52/169.5
5,673,521 A * 10/1997 Coulton et al. ..... 52/199
6,308,472 B1 * 10/2001 Coulton et al. ..... 52/198
6,786,013 B2 * 9/2004 Coulton ..... 52/198
6,797,356 B2 * 9/2004 Zupon et al. ..... 428/131
7,182,688 B2 * 2/2007 Coulton ..... 454/365
7,604,536 B2 * 10/2009 Coulton et al. ..... 454/365
7,698,858 B2 * 4/2010 Schroer et al. ..... 52/169.5
7,858,174 B2 * 12/2010 Ehrman et al. ..... 428/299.7
7,908,801 B2 * 3/2011 Nielsen et al. ..... 52/169.5
2003/0124315 A1 * 7/2003 Grochoski ..... 428/180
2004/0000113 A1 * 1/2004 Alderman ..... 52/407.5
2005/0229524 A1 * 10/2005 Bennett et al. ..... 52/481.1

* cited by examiner

*Primary Examiner* — Adriana Figueroa

(57) ABSTRACT

The present invention comprises an effective manufactured insulation and ventilating assembly that can insulate a structure, usually in roofing or exterior wall applications, from conductive, convective and radiant heat. The radiant insulating and venting assembly is comprised of a rigid upper layer that is moisture resistant. The bottom layer of the assembly is made up of a radiant reflective surface. Between the rigid upper moisture resistant layer and the radiant reflective layer are non-collapsing air spacer columns, approximately ⅝ths to 1 inch in length, that create the needed air space for effective radiant heat reflection and air and moisture venting. The radiant reflective layer may be attached to the ends of the air spacers during the rigid upper layer and air spacer manufactured forming or the radiant reflective layer may be applied to the roof sheathing or rafters, or to the wall sheathing or wall stud members before the formed rigid layer with air spacers is applied to the roofing or wall application.

6 Claims, 2 Drawing Sheets

RADIANT INSULATING, VENTING AND MOISTURE CONTROL ASSEMBLY

CROSS-REFERENCED TO RELATED APPLICATIONS

Figure 1:
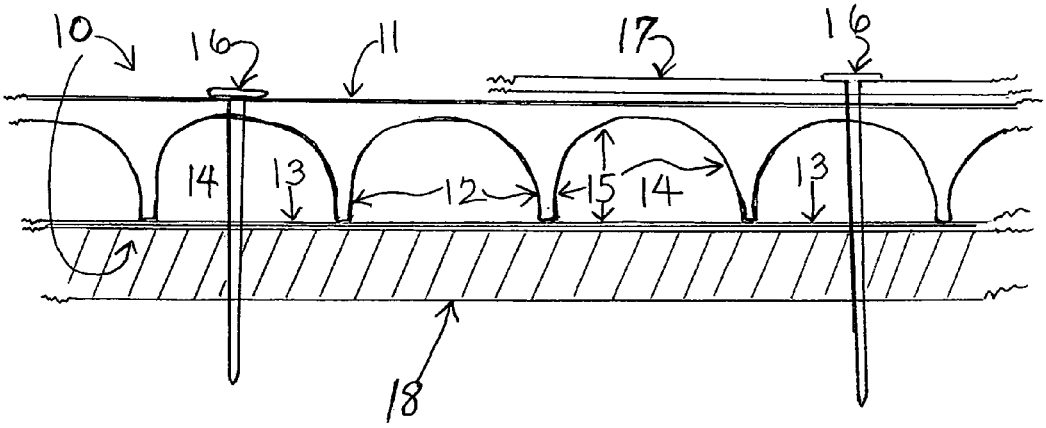

This application is a continuation-in-part of application Ser. No. 12/923,972 filed Oct. 19, 2010 now U.S. Pat. No. 8,291,660.

BACKGROUND OF THE INVENTION

Roofs and walls of a building or structure must deal with various environmental and interior building factors such as heat insulation, proper venting and moisture control. The design of the roof and wall systems needs to be structurally sound while providing for a habitable temperature living space. There are three sources of heat that affect the ability of a building structure's insulation to control heat transfer. The "insulation" or heat control of the temperature controlled space may be broadened to include dealing with moisture.

Convective heat transfer is the movement of air either naturally as in where hot air rises displacing the cold air (moves the cold air down), or the mechanical convection when air is physically moved such as by a fan. Convective heat movement accounts for about 15 to 20% of heat loss/transfer (air leakage) through exterior walls.

Conductive heat is the transfer of heat energy from one object by touch to another object. Thermal bridging of solid studs in a wall is an example of conductive heat loss bridging between external face covering to interior wall covering.

Radiant heat is the absorption of radiant energy emitted by a heated object. Approximately 60 to 75% of total heat transfer in a residence or building occurs through radiation, can be as much as 90% heat gain in the attic/ceiling in the summer time.

Improper venting and moisture control can impact the ability of the wall or roof system to control heat (insulation saturation with moisture and collapse) and to maintain the structural integrity of the building (rot, decay, or insects). Moisture control and drainage in the exterior wall is critical in certain applications such as brick and stucco where there may be through face leakage.

Heat insulation material placed in/or part of walls, ceiling, roofs, floors and other "wall structures" have historically been comprised of fibrous blanket insulation, such as fiberglass or foam insulation board. The principle of the blanket insulation is to form dead air spaces that provide insulation against convection and conduction heat transfer. The blanket insulation can be formed in small "clumps" and blown into spaces such as into the attics of residential homes and other building structures, and can also be made into elongated blankets formed in a specific width and depth that is suitable for placement between parallel joist, studs, rafters, and other parallel support structures that are uniformly spaced apart.

Foam insulation board is usually placed on the exterior sheathing surrounding the structure and is a good insulator against conductive and convective heat transfer. Foam insulation board is usually made up of extruded or pressed sheets made of expanded polystyrene (EPS), extended polystyrene (XPS), and polyisocyanurate (polyiso). Rigid foam board insulation provide high R-value with minimum thickness; low weight allows for easier installation and shipping cost; energy required to produce polystyrene foam insulation is 24 percent less than the energy required to make the equivalent R-value of fiberglass insulation (green product); High resistance to mold.

In the recent past, an additional sheet of reflective material has been applied to one of the broad surfaces of the fibrous blanket and foam insulation board. The radiant reflective surface can be effective in reflecting radiant heat if the reflective surface faces the source of the radiant heat and there is an approximately a ¾ inch air space between the reflective surface and another surface.

Radiant reflective insulation can be as simple as aluminum foil to multiple layered assemblies such as foil-bubble-foil with foam insulation possibly added as a layer. The reflective material, such as aluminum reflective insulation, can functions as a barrier to radiant heat transfer when applied in the right location and having the needed air space between the reflective surface and another material. Reflective insulation has many benefits: very thin; can be stabled and glued; easy to cut; does not promote mildew, mold, or fungus growth; reflective insulation can have, when applied correctly, a higher R-value than most other type of insulation. A ¼ inch of reflective insulation has more insulation than 6 inches of common fiberglass bat.

But most of the radiant reflective insulation on the market today does not address one of the major requirements for effective radiant reflection. One of the problems or inefficiencies of many of the radiant reflective applications is that when reflective surfaces of the foil engage another surface, such as the fiberglass of an adjacent insulation blanket or the adjacent gypsum foam board or other wall structure, such as siding, the foil looses a considerable amount of its ability to reflect heat (air space requirement). The reflective side of the radiant insulation needs to face the source of the radiant energy to effectively reflect back radiant heat. When radiant reflective material touches or is too close to a solid object much of the radiant heat is converted to conductive heat. Also the less material the reflected back radiant energy has to move through the better the total percentage amount that radiant heat is transferred out of the area being temperature controlled.

Another problem with the use of reflective surface on combination with other insulation materials is that the surface should become dirty from an accumulation of dust, trash, fibers, vapors, etc., the reflective sheet loses its ability to reflect radiant heat. There needs to be a protective covering spaced apart from the reflective surface.

One of the most significant factors that can limit the effective use of the current radiant reflective insulation is that they collapse or compress when roofing, wall siding or other hard material is applied resulting in inefficient radiant heat reflection. In most of the current radiant insulation manufactured assemblies the air space is usually not wide enough for effective radiant heat reflection and any compression on their surface further reduces the needed radiant reflective air space.

SUMMARY OF THE INVENTION

Briefly described, the present invention comprises an economical and effective heat insulation assembly that can assist in insulating the structure from radiation heat transfer through walls, roofs or in other radiant reflective applications. The radiant insulation configuration can also assist with air and moisture venting. The radiant insulating and venting assembly is comprised of a fairly rigid top or upper protective moisture resistant layer. Non-collapsing columns or air spacers are adhered or formed to the underside of the rigid moisture resistant upper layer, the other ends of the air spacers, are attached to or is placed upon a lower radiant reflective layer. The moisture resistant upper layer is held separated, approximately $\frac{5}{8}^{th}$ to 1 inch, from the bottom reflective layer by the attached or formed spacers columns or air spacers, creating the needed air space for effective radiant reflection. When the radiant insulating assembly is used under roofing or exterior wall coverings, such as sidings, brick or stucco, the upper rigid layer is acts like a composite roof or wall sheathing resisting moisture and the air spacer columns maintain the air space for efficient radiant heat reflection and possibly venting air and moisture. The vented air under the roofing may also assist in extending the useful life of the roofing material.

The modulus composition stiffness of the moisture resistant rigid upper layer in conjunction with the compression resistance of the air spacers will not allow the upper layer to overly deflect or crack when roofing or siding is applied. The radiant assembly may also be used as the primary roof or wall sheathing when the rigid upper layer and air spacer columns are manufactured to specific dimensions and material composition. The spacer columns need to be stiff enough to maintain the radiant/venting air space even under some loading and usual roof foot traffic. The spacers are also designed where a small portion of the spacer touches the reflective surface allowing the majority of the surface to effectively reflect radiant heat. The reflective radiant layer may not be attached to the bottom of the air spacers during manufacturing but may be placed on the roof sheathing or roof rafters, or to wall studs or sheathing before the rigid top layer with attached air spacers is placed on the radiant reflective layer. The top protective water resistant layer helps protect the reflective surfaces of the reflective sheet from the accumulation of dirt, dust, insulation fiber, vapor and other things that would occlude or diminish the reflective properties of the reflective surface of the reflective sheet.

The air spaces of the radiant insulating and venting assembly can also be used, in conjunction with effective radiant heat reflection, to vent air and to allow moisture to be removed or evaporated. This can be very useful in geographic areas where there are high levels of exterior moisture and warm temperatures or in colder areas with varying interior/exterior temperatures and moisture levels. If moisture is not controlled then rot, interior wall freezing, mold, mildew and other complications can occur including reduction in insulation effectiveness.

BRIEF DESCRIPTION OF THE INVENTION

FIG. 1. Shows in a side cross sectional view the components of the radiant insulating and venting assembly placed under roofing and upon the roof sheathing.

Figure 2:
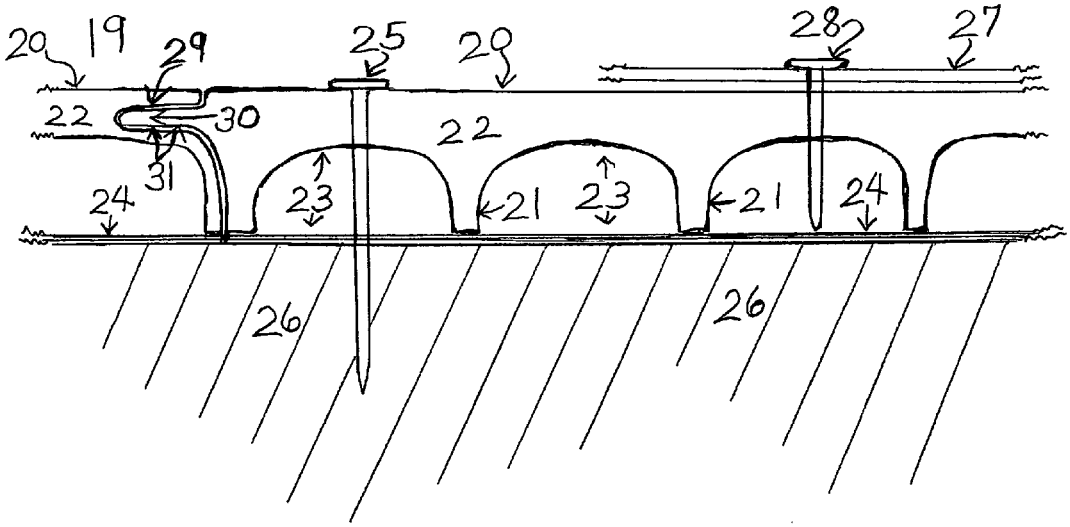

FIG. 2. Demonstrates in a side cross sectional view the radiant insulating and venting assembly being applied as the primary roof sheathing in a roofing application.

DETAILED DESCRIPTION OF THE PREFERRED EMBODIMENTS

Shown in FIG. 1. in a cross sectional view is the radiant insulating and venting assembly 10 components, used in a roofing application. Shown is the rigid moisture resistant upper layer 11 with the non-collapsing air spacer columns 12. The ends of the air spacers 12 are placed upon the radiant reflective layer 13. The air spaces 14 are created by the air cavities 15 between the air spacers 12, the rigid upper layer 11 and the radiant reflective layer 13. Nails, screws or other attaching mechanisms 16 adheres the radiant insulating and venting assembly 10 and the roofing 17 through the rigid moisture resistant upper layer 11 and the radiant reflective layer 13 into the roof sheathing 18.

FIG. 2. shows in a cross sectional view the radiant insulating and venting assembly 19 used in a roofing application where the rigid upper moisture resisting layer 20 with the attached air spacers 21 is used as the primary roof sheathing 22. Shown are the created air spaces 23 between the air spacers 21, the rigid upper layer 20 and the radiant reflective layer 24. Nails, screws or other attaching mechanisms 25 attach the radiant reflective and venting assembly 10 to the roof rafters or purlins 26. The roofing 27 is attached by attaching mechanisms 28 to the rigid moisture resistive upper layer 20 as the primary roof sheathing 22 with no other roof sheathing required. Shown also is the recessed slot 29 on the edge of the rigid upper layer 20 that the insert extensions 30 slides into the recessed slot 29, forming the abutting edge joint 31.

One preferred method of application of the rigid top layer manufactured radiant insulating and venting assembly as described above is when the radiant insulating assembly is used to insulate upon the top of the roof decking or as the roof decking. Another method of application is when the radiant insulating assembly is placed upon stud members or as sheathing in exterior wall assemblies. The created air spaces help to evaporate moisture and the reflective layer reflects radiant heat back outward to the exterior and in some geographic application the interior side of the radiant insulating assembly's reflective layer is radiant reflective to reflect heat back to the interior of a structure, usually in the cooler months.

In both the roofing and the wall applications the radiant insulating assembly may be manufactured adhered to other insulation such as foam or fibrous insulation and the radiant insulating assembly may not be covered with roofing or siding for an extended period of time. In some applications the radiant insulating assembly may act as either roofing or siding where the protective layer's exterior surface may have added UV protection and/or the exterior surface of the protective layer may be periodically coated to extend its usability.

In most configurations of the radiant insulating and venting assembly the rigid upper moisture resistant layer may be an edge extension over the recessed edge or have an extension receiving recess slot on at least one edge, to produce an overlap or slot insertion of the edges of abutting rigid upper layers. The overlap or tongue and grove style slot insertion may be used to assist in sealing out moisture and/or air and may add strength to the two rigid layers edge connection.

The invention claimed is:

1. A radiant insulating, venting and moisture vapor assembly, comprising:

a. an upper layer that is a rigid layer; and b. non-collapsing approximate ⅝ths to 1 inch columns or air spacers attached, extruded or molded with and on the lower surface of the rigid upper layer, and c. a radiant reflective layer that the air spacer or columns are attached or rest upon and the air spacers ends touch a small percent of 10 to 15 percent of the radiant reflective surface minimizing conductive heat transfer, allowing the radiant reflective surface to effectively reflect back 85 to 90 percent radiant heat in the desired direction outward past the rigid layer;

d. wherein a cavity or air space formed between the rigid upper layer and the radiant reflective layer is designed to allow air and moisture vapor to flow into the open venting edges of the assembly, to flow around said air spacers and out the open venting edges of the radiant insulating and venting assembly, and e. wherein said rigid upper layer in conjunction with the compression stability of the attached air spacers will allow applied roofing material and exterior above grade wall coverings of siding, cement composition boards, vinyl brick or stucco, to be attached to or through the radiant insulating assembly, wherein the flexural strength of the rigid upper layer and the lack of compression collapsing of the air spacers allows the radiant insulating assembly to have the continued capacity for effective radiant heat reflection, air and/or moisture venting.

2. A radiant insulating assembly according to claim 1, further being manufacture attached on either layer face to various forms of insulation such as fibrous or foam insulation.

3. A radiant insulating assembly according to claim 1, wherein the radiant insulating assembly is attached to either the exterior side of roof decking, roof rafters or purlins, or to the exterior side of a wall structure, wherein said protective layer is UV treated or periodically recoated to allow the radiant insulating assembly to remain uncovered for an extended period of time.

4. A radiant insulating assembly according to claim 1, wherein the edges of the rigid upper layer have extensions and recesses to allow the rigid upper layer edges to overlap to an abutting rigid upper layer edge to form a joint to seal out moisture and air.

5. A radiant insulating and venting assembly according to claim 1, wherein the radiant reflective surface of the radiant insulating and venting assembly can either be attached to the end of the air spacer during the manufacturing process of attaching, forming or extruding the rigid upper layer to the air spacer columns, or the radiant reflective layer may first be placed on the roofing sheathing, rafters or purlins, or on the wall sheathing or stud members and then the rigid upper layer with attached air spacers is placed upon the radiant reflective layer in the roofing or wall application.

6. A radiant insulating and venting assembly according to claim 1, wherein the rigid upper layer acts as the primary roof or wall sheathing where roof or wall covering is attached to the rigid upper moisture resistive layer and there is no other roof or wall sheathing needed to hold roofing, underlayment or exterior wall covering.

* * * * *